US009056235B1

(12) United States Patent
Mortland

(10) Patent No.: US 9,056,235 B1
(45) Date of Patent: Jun. 16, 2015

(54) PUNCHING BAG GANTRY ASSEMBLY

(71) Applicant: David Mortland, Sylvania, OH (US)

(72) Inventor: David Mortland, Sylvania, OH (US)

( * ) Notice: Subject to any disclaimer, the term of this patent is extended or adjusted under 35 U.S.C. 154(b) by 200 days.

(21) Appl. No.: 13/772,854

(22) Filed: Feb. 21, 2013

Related U.S. Application Data

(60) Provisional application No. 61/601,586, filed on Feb. 22, 2012.

(51) Int. Cl.
*A63B 69/24* (2006.01)
*E04C 3/08* (2006.01)

(52) U.S. Cl.
CPC .. *A63B 69/24* (2013.01); *E04C 3/08* (2013.01)

(58) Field of Classification Search
CPC ..... A63B 69/004; A63B 69/34; A63B 2225/093; A63B 69/201; A63B 69/20; A63B 71/023; A63B 69/24; A63B 69/205; A63B 69/203; A63B 69/206; A63B 2071/024; A63B 2220/53; A63B 2244/102; A63B 2021/169; E04C 3/08
USPC ..... 482/83, 87, 89–90, 167; 52/223.8–223.13, 127.2, 147, 152, 52/650.1, 648.1, 651.08; 403/187, 205, 403/231, 256–261
See application file for complete search history.

(56) References Cited

U.S. PATENT DOCUMENTS 2,650,749 A * 9/1953 Balogh ..... 182/220
3,399,891 A * 9/1968 McCormick et al. ..... 473/442
3,817,006 A * 6/1974 Williams ..... 52/127.2
4,216,957 A * 8/1980 Curatola ..... 482/90
4,350,318 A * 9/1982 Gallis ..... 249/40
4,641,987 A * 2/1987 Schlegel ..... 403/169
5,061,111 A * 10/1991 Hosokawa ..... 403/232.1
5,137,250 A * 8/1992 McCracken ..... 249/40
5,224,912 A * 7/1993 Moody ..... 482/87
5,242,239 A * 9/1993 Hosokawa ..... 403/258
5,328,287 A * 7/1994 Gilb ..... 403/231
5,761,874 A * 6/1998 Hayakawa ..... 52/701
5,802,780 A * 9/1998 Hammerschlag ..... 52/105
6,298,630 B1 * 10/2001 VeRost et al. ..... 52/712
6,314,694 B1 * 11/2001 Cooper et al. ..... 52/309.12
6,348,028 B1 * 2/2002 Cragg ..... 482/148
6,439,344 B1 * 8/2002 Cole ..... 182/113
7,152,843 B2 * 12/2006 Ward et al. ..... 249/216
7,571,737 B2 * 8/2009 Jang ..... 135/146
7,658,699 B1 * 2/2010 Johnson, Jr. ..... 482/87
7,914,224 B2 * 3/2011 Fu ..... 403/241
7,959,126 B2 * 6/2011 Lee ..... 249/40
8,342,475 B2 * 1/2013 Tsakiris ..... 248/611
2002/0169054 A1 * 11/2002 Schwendemann ..... 482/87
2003/0051433 A1 * 3/2003 Koo ..... 52/745.19
2004/0049994 A1 * 3/2004 Hazenstab ..... 52/127.2
2004/0096266 A1 * 5/2004 Birnbaum et al. ..... 403/187
2005/0003936 A1 * 1/2005 Schwendemann ..... 482/87

(Continued)

*Primary Examiner* — Loan H Thanh
*Assistant Examiner* — Andrew S Lo
(74) *Attorney, Agent, or Firm* — Fraser Clemens Martin & Miller LLC; Charles F. Charple

(57) ABSTRACT

A gantry assembly for use with one or more suspended exercise objects is provided. The gantry assembly includes a plurality of opposing support members and a main beam assembly supported by the plurality of support members. One or more suspended exercise objects is connected to the main beam assembly. The gantry assembly is configured to support the weight of the one or more suspended exercise objects and further configured to support the impact and rotational forces created during use of the suspended exercise objects.

16 Claims, 3 Drawing Sheets

(56) References Cited

U.S. PATENT DOCUMENTS

| | | | | |
|---|---|---|---|---|
| 2006/0058164 | A1* | 3/2006 | Miller et al. | 482/87 |
| 2006/0179728 | A1* | 8/2006 | Lang | 52/127.2 |
| 2006/0194675 | A1* | 8/2006 | Valentine | 482/83 |
| 2007/0175174 | A1* | 8/2007 | Bruno | 52/745.12 |
| 2008/0131197 | A1* | 6/2008 | Hamlen | 403/231 |
| 2008/0139367 | A1* | 6/2008 | Cooper | 482/83 |
| 2008/0202043 | A1* | 8/2008 | Marshall et al. | 52/127.2 |
| 2009/0026338 | A1* | 1/2009 | Bruce | 248/346.06 |
| 2009/0190996 | A1* | 7/2009 | Clarke | 403/188 |
| 2010/0166497 | A1* | 7/2010 | Vilasineekul | 403/205 |
| 2010/0186346 | A1* | 7/2010 | Bratton | 52/831 |
| 2010/0190612 | A1* | 7/2010 | Cook | 482/38 |
| 2013/0216300 | A1* | 8/2013 | Braeutigam | 403/205 |
| 2013/0319296 | A1* | 12/2013 | Lio et al. | 108/157.1 |

* cited by examiner

PUNCHING BAG GANTRY ASSEMBLY

RELATED APPLICATIONS

This application claims the benefit of U.S. Provisional Application No. 61/601,586, filed Feb. 22, 2012, the disclosure of which is incorporated herein by reference in its entirety.

BACKGROUND

Exercise facilities and training facilities often have punching bags and/or other suspended objects for use in exercising and training. In certain instances, the punching bags are mounted to structures that sit on a floor. In other instances, the punching bags are mounted to structures and other support systems that are suspended from ceilings or walls. However, the structures and support systems for suspended punching bags can often lack structural integrity, thereby leading to broken or disabled mounting systems.

It would be advantageous if structures for suspended punching bags could be improved.

SUMMARY OF THE INVENTION

The above objects, as well as other objects not specifically enumerated, are achieved by a gantry assembly for use with one or more suspended exercise objects. The gantry assembly includes a plurality of opposing support members and a main beam assembly supported by the plurality of support members. One or more suspended exercise objects is connected to the main beam assembly. The gantry assembly is configured to support the weight of the one or more suspended exercise objects and further configured to support the impact and rotational forces created during use of the suspended exercise objects.

Various objects and advantages of the punching bag gantry assembly will become apparent to those skilled in the art from the following detailed description of the preferred embodiment, when read in light of the accompanying drawings.

DETAILED DESCRIPTION OF THE INVENTION

The present invention will now be described with occasional reference to the specific embodiments of the invention. This invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the present invention. Notwithstanding that the numerical ranges and parameters setting forth the broad scope of the invention are approximations, the numerical values set forth in the specific examples are reported as precisely as possible. Any numerical values, however, inherently contain certain errors necessarily resulting from error found in their respective measurements.

The description and figures disclose a punching bag gantry assembly (hereafter "gantry assembly") for use with multiple suspended punching bags. Generally, the gantry assembly is configured to provide a structurally sound mounting system for one or more suspended punching bags. While this description describes, and the figures show, multiple punching bags, it should be appreciated that the gantry assembly can be used to suspend other objects for use in exercising and training. Non-limiting examples of other suspended objects include speed bags, double end bags, grappling bags, training dummies weights, bars, straps, poles and slings. The term "punching bag", as used herein, is defined to mean any bag or shape suspended for free movement and punched for exercise or training. The term "gantry assembly", as used herein, is defined to mean any structure sufficient to suspend multiple punching bags.

Figure 2:
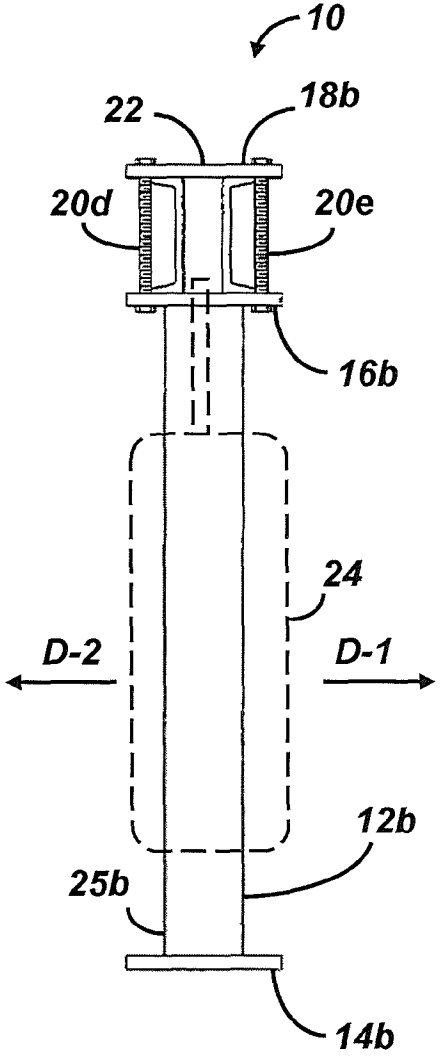
FIG. 2 is a left side view, in elevation, of the punching bag gantry assembly of FIG. 1.
Figure 1:
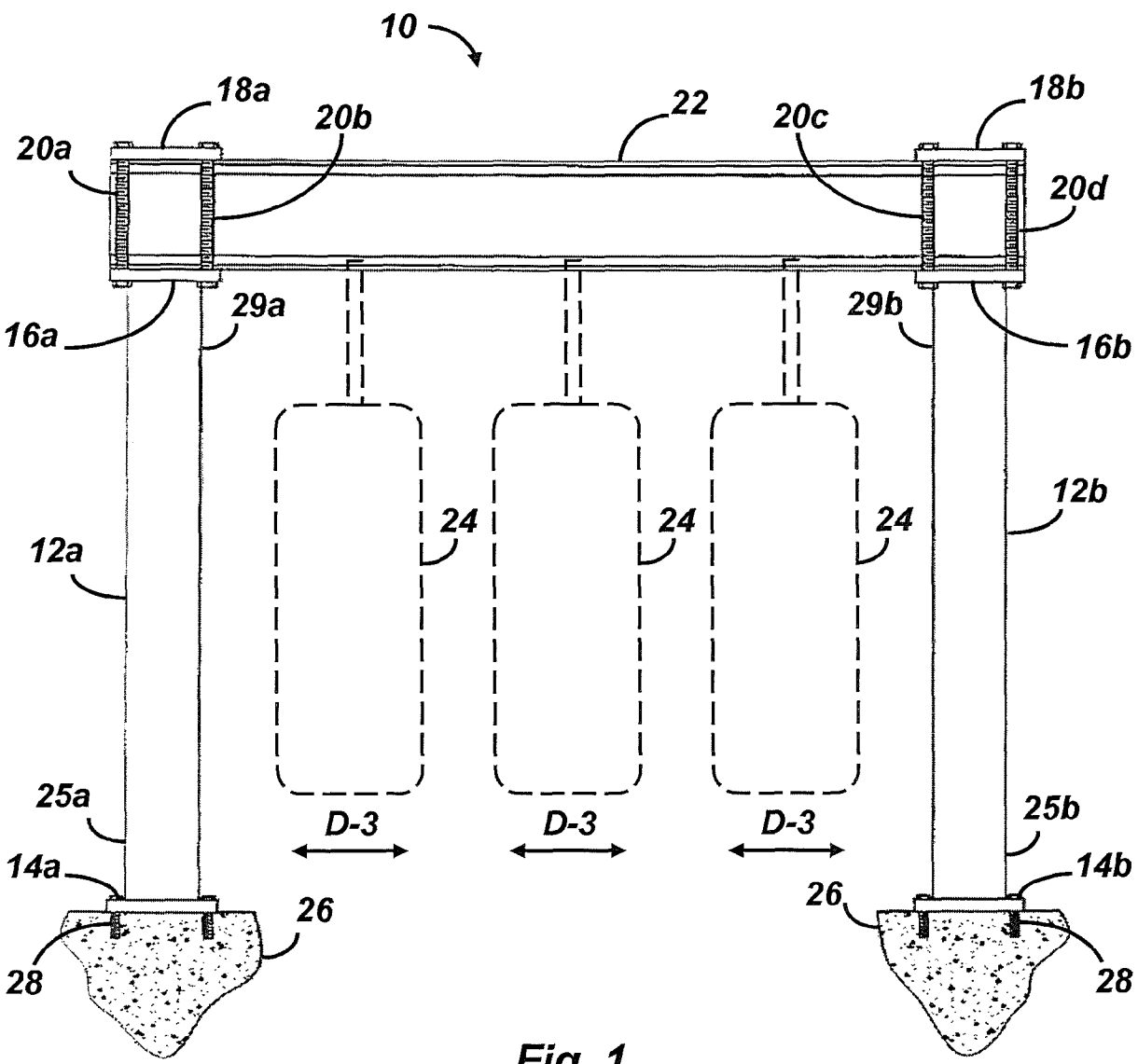
FIG. 1 is a front view, in elevation, of a first embodiment of a punching bag gantry assembly.

Referring now to FIGS. 1 and 2, a first embodiment of a gantry assembly is shown generally at 10. The gantry assembly 10 includes opposing first and second support members 12*a*, 12*b*, first and second base plates 14*a*, 14*b*, first and second support plates 16*a*, 16*b*, first and second top plates 18*a*, 18*b*, a plurality of connectors 20*a*-20*h* (for purposes of simplicity, only connectors 20*a*-20*d* are illustrated in FIG. 1 and only connectors 20*d* and 20*e* are illustrated in FIG. 2) and a main beam assembly 22. Generally, the gantry assembly 10 is configured to structurally support a plurality of suspended punching bags 24 such that any combination of the suspended punching bags 24 can be used simultaneously.

Referring again to FIGS. 1 and 2, the gantry assembly 10 is configured to allow free movement of the suspended punching bags 24. The term "free movement", as used herein, is defined to mean in a front-to back direction as indicated by direction arrow D-1 in FIG. 2, or a back-to-front direction as indicated by direction arrow D-2, or a side-to-side direction as indicated by direction arrows D-3 in FIG. 1, or any combination of the aforementioned directions.

Referring again to FIG. 1, the first and second support members 12*a*, 12*b* are configured to structurally support the weight of the main beam assembly 22 and the weight of the suspended punching bags 24. The first and second support members are also configured to support the impact and rotational forces created during use of the suspended punching bags 24. In the illustrated embodiment, the first and second support members 12*a*, 12*b* are tubular members having a square cross-sectional shape, with each side of the square cross-sectional shape having a dimension of about 8.0 inches. In other embodiments, the first and second support members 12*a*, 12*b* can have other cross-sectional shapes, such as the non-limiting examples of circular or I-beam cross-sectional shapes sufficient to support the weight of the main beam assembly 22 and the suspended punching bags 24 and the forces created during use of the suspended punching bags 24. In still other embodiments, the first and second support members 12*a*, 12*b* can have any desired dimensional size sufficient to support the weight of the main beam assembly 22 and the suspended punching bags 24 and the forces created during use of the suspended punching bags 24.

While the embodiment shown in FIG. 1 illustrates the use of two support members 12*a*, 12*b*, it should be appreciated that in other embodiments, more than two support members can be used to support the weight of the main beam assembly 22 and the suspended punching bags 24 and the forces created during use of the suspended punching bags 24.

Referring again to FIGS. 1 and 2, the first and second support members 12*a*, 12*b* each have a first end 25*a*, 25*b*. The first end 25*a* of the first support member 12*a* is attached to the first base plate 14*a*. In a similar manner, the first end 25*b* of the second support member 12*b* is attached to the second base plate 14*b*. In the illustrated embodiment, the first and second support members 12*a*, 12*b* are attached to the first and second base plates 14*a*, 14*b* by welding. In other embodiments, the first and second support members 12*a*, 12*b* can be attached to the first and second base plates 14*a*, 14*b* by other desired methods, such as the non-limiting example of mechanical fasteners. In still other embodiments, the first and second support members 12*a*, 12*b* can be formed such as to have integral base plates.

The first and second base plates 14*a*, 14*b* are attached to a floor 26 by a plurality of fasteners 28 extending through the first and second base plates 14*a*, 14*b*. The fasteners 28 are configured to secure the gantry assembly 10 to the floor 26 as the gantry assembly is used. In the illustrated embodiment, the fasteners 28 are concrete anchors. Alternatively, the fasteners 28 can be other desired mechanisms sufficient to secure the gantry assembly 10 to the floor 26 as the gantry assembly is used. In still other embodiments, the base plates 14*a* and 14*b* can be attached to the floor by other desired structures or devices, such as for example retaining clips.

Referring again to FIGS. 1 and 2, the first and second support members 12*a*, 12*b* each have a second end 29*a*, 29*b*. The second end 29*a* of the first support member 12*a* is fastened to the first support plate 16*a*. In a similar manner, the second end 29*b* of the second support member 12*b* is fastened to the second support plate 16*b*. In the illustrated embodiment, the first and second support members 12*a*, 12*b* are fastened to the first and second support plates 16*a*, 16*b* by welding. In other embodiments, the first and second support members 12*a*, 12*b* can be fastened to the first and second support plates 16*a*, 16*b* by other desired methods, such as the non-limiting example of mechanical fasteners. In still other embodiments, the first and second support members 12*a*, 12*b* can be formed such as to have integral support plates.

Figure 3:
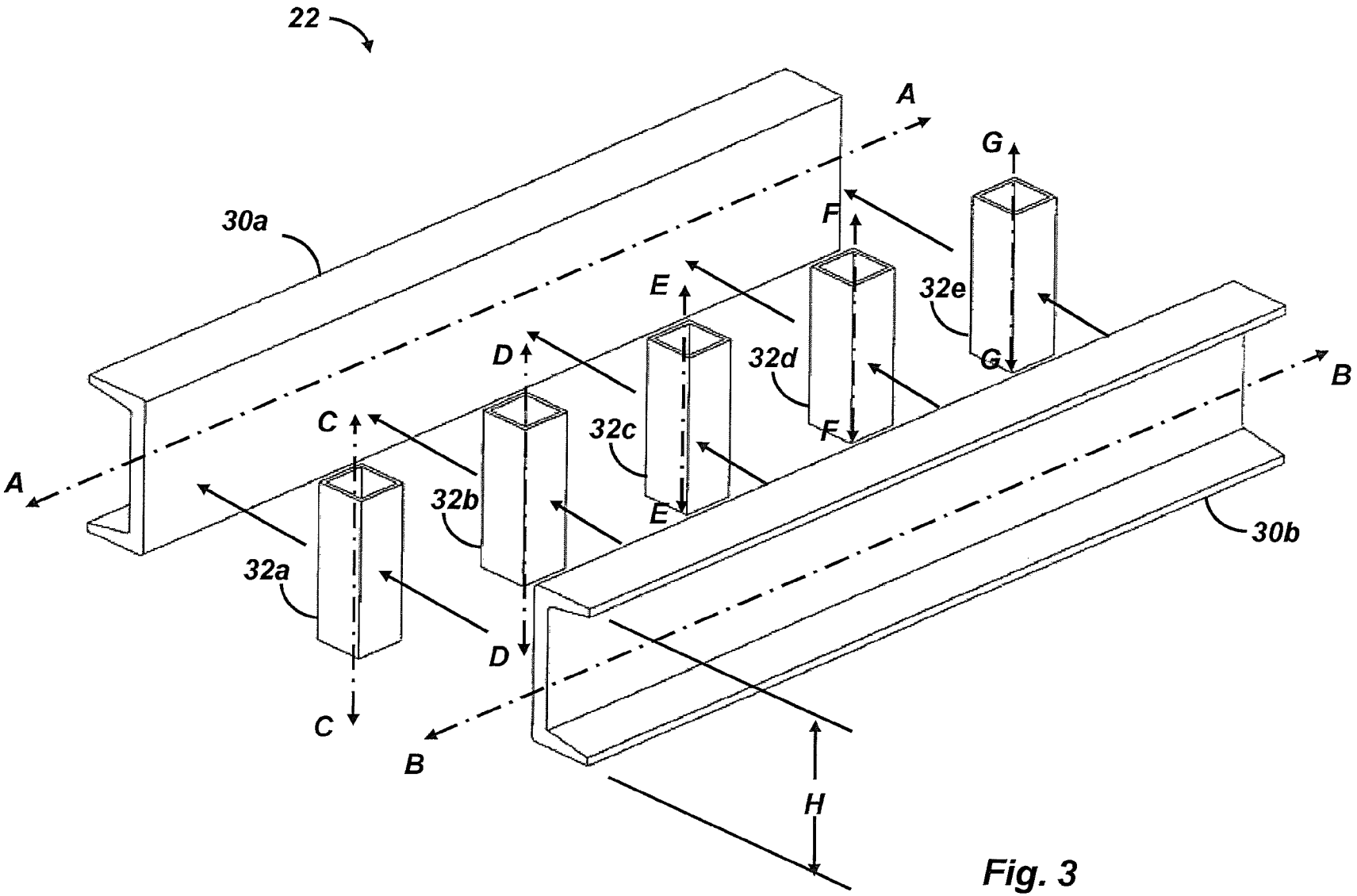
FIG. 3 is an exploded perspective view of a portion of the punching bag gantry assembly of FIG. 1.

The first and second support plates 16*a*, 16*b* are configured to provide a supporting surface for the main beam assembly 22. Referring now to FIG. 3, the main beam assembly 22 is configured to structurally support the weight of the suspended punching bags. The main beam assembly 22 is further configured to structurally support the impact and rotational forces created during use of the suspended punching bags. The main beam assembly 22 includes opposing first and second beams 30*a*, 30*b* and a plurality of spaced apart spacing members 32*a*-32*e* positioned therebetween. Without being held to the theory, it is believed that the combination of the spacing members 32*a*-32*e* and the opposing first and second beams 30*a*, 30*b* provides sufficient structural integrity to the main beam assembly 22 to support not only the weight of the suspended punching bags, but also the impact and rotational forces created during use of the suspended punching bags. In the illustrated embodiment, each of the opposing first and second beams 30*a*, 30*b* has the cross-sectional shape of a channel. However, in other embodiments, each of the opposing first and second beams 30*a*, 30*b* can have other desired cross-sectional shapes sufficient such that the combination of the spacing members 32*a*-32*e* and the opposing first and second beams 30*a*, 30*b* provides sufficient structural integrity to the main beam assembly 22 to support not only the weight of the suspended punching bags, but also the impact and rotational forces created during use of the suspended punching bags. In the illustrated embodiment, each of the opposing first and second beams 30*a*, 30*b* has a height H of about 8.0 inches and a sectional area of about 5.51 square inches. In other embodiments, each of the opposing first and second beams 30*a*, 30*b* can have a height H of more or less than about 8.0 inches and a sectional area of more or less than about 5.51 square inches.

Referring again to FIG. 3, each of the spacing members 32*a*-32*e* has the cross-sectional shape of a square tube. However, in other embodiments, each of the spacing members 32*a*-32*e* can have other cross-sectional shapes, such as for example a rectangular cross-sectional shape, sufficient such that the combination of the spacing members 32*a*-32*e* and the opposing first and second beams 30*a*, 30*b* provides sufficient structural integrity to the main beam assembly 22 to support not only the weight of the suspended punching bags, but also the impact and rotational forces created during use of the suspended punching bags. In the illustrated embodiment, each of the spacing members 32-32*e* has nominal dimensions of 4.0 inches by 4 inches and a sectional area of about 6.02 square inches. In other embodiments, each of the spacing members 32*a*-32*e* can have other nominal dimensions, such as for example 6.0 inches by 6.0 inches and a sectional area of more or less than about 6.02 square inches.

While the embodiment shown in FIG. 3 illustrates that each of the spacing members 32*a*-32*e* have the same cross-sectional shape, it should be appreciated that in other embodiments, each of the spacing members 32*a*-32*e* can have a different cross-sectional shape.

Referring again to FIG. 3, the first beam 30*a* has a longitudinal central axis A-A. Similarly, the second beam 30*b* has longitudinal central axis B-B. Each of the spacing members 32*a*-32*e* has a longitudinal central axis C-C, D-D, E-E, F-F and G-G respectively. The various axes will be discussed in more detail below.

Referring again to FIG. 3, the main beam assembly 22 is assembled by first attaching each of the spacing members 32*a*-32*e* to the first beam 30*a*, thereby forming a first beam and spacer assembly. The spacing members 32*a*-32*e* are attached to the first beam 30*a* such that each of the longitudinal central axes C-C, D-D, E-E, F-F and G-G are substantially perpendicular to the longitudinal central axis A-A of the first beam 30*a*. The term "substantially perpendicular", as used herein, is defined to mean an orientation within a range of from about 80° to about 100°.

In a next step, the second beam 30*b* is attached to the first beam and spacer assembly, thereby forming the main beam assembly 22. The second beam 30*b* is attached to the spacing members 32*a*-32*e* such that the longitudinal central axis B-B of the second beam 30*b* is substantially perpendicular to each of the longitudinal central axes C-C, D-D, E-E, F-F and G-G of the spacing members 32*a*-32*e*. Without being held to the theory, it is believed that the substantially perpendicular orientation of the longitudinal central axes A-A and B-B of the first and second beams 30*a*, 30*b* to each of the longitudinal central axes C-C, D-D, E-E, F-F and G-G of the spacing members 32*a*-32*e* provides sufficient structural integrity to the main beam assembly 22 to support not only the weight of the suspended punching bags, but also the impact and rotational forces created during use of the suspended punching bags.

In the illustrated embodiment, each of the spacing members 32*a*-32*e* is attached to each of the first and second beams 30*a*, 30*b* by welding. Alternatively, each of the spacing members 32*a*-32*e* can be attached to the first and second beams 30*a*, 30*b* by other desired methods, such as the non-limiting example of mechanical fasteners.

While the embodiment shown in FIG. 3 illustrates the use of five spaced apart spacing members 32*a*-32*e*, it should be appreciated that in other embodiments, more than five spacing members can be used to support the weight of the main beam assembly 22 and the suspended punching bags and the forces created during use of the suspended punching bags.

Referring again to FIGS. 1 and 2 in a next step, the assembled main beam assembly 22 is positioned atop the first and second support plates 16*a*, 16*b*. The first and second top plates 18*a*, 18*b* are positioned atop the assembled main beam assembly 22 such that apertures in the first and second support plates 16*a*, 16*b* and first and second top plates 18*a*, 18*b* align. Next, the connectors 20*a*-20*h* are positioned in the aligned apertures. The connectors 20*a*-20*h* are tighten such that the assembled main beam assembly 22 is secured between the first and second support plates 16*a*, 16*b* and first and second top plates 18*a*, 18*b*. In the illustrated embodiment, the connectors 20*a*-20*h* include threaded rods and correspondingly threaded nuts. However, in other embodiments the connectors 20*a*-20*h* can be other desired mechanisms, structures or devices.

In the embodiment illustrated in FIGS. 1-3, the first and second support members 12*a*, 12*b*, the first and second base plates 14*a*, 14*b*, the first and second support plates 16*a*, 16*b*, the first and second top plates 18*a*, 18*b*, the first and second beams 30*a*, 30*b* and the spacing members 32*a*-32*e* are made from a metallic material, such as for example, steel. Alternatively, the first and second support members 12*a*, 12*b*, the first and second base plates 14*a*, 14*b*, the first and second support plates 16*a*, 16*b*, the first and second top plates 18*a*, 18*b*, the first and second beams 30*a*, 30*b* and the spacing members 32*a*-32*e* can be made from other materials, including the non-limiting examples of aluminum or reinforced polymeric materials. Further, the first and second support members 12*a*, 12*b*, the first and second base plates 14*a*, 14*b*, the first and second support plates 16*a*, 16*b*, the first and second top plates 18*a*, 18*b*, the first and second beams 30*a*, 30*b* and the spacing members 32*a*-32*e* can have any desired surface finish or coating, such as for example, a rust-preventative coating.

Figure 4:
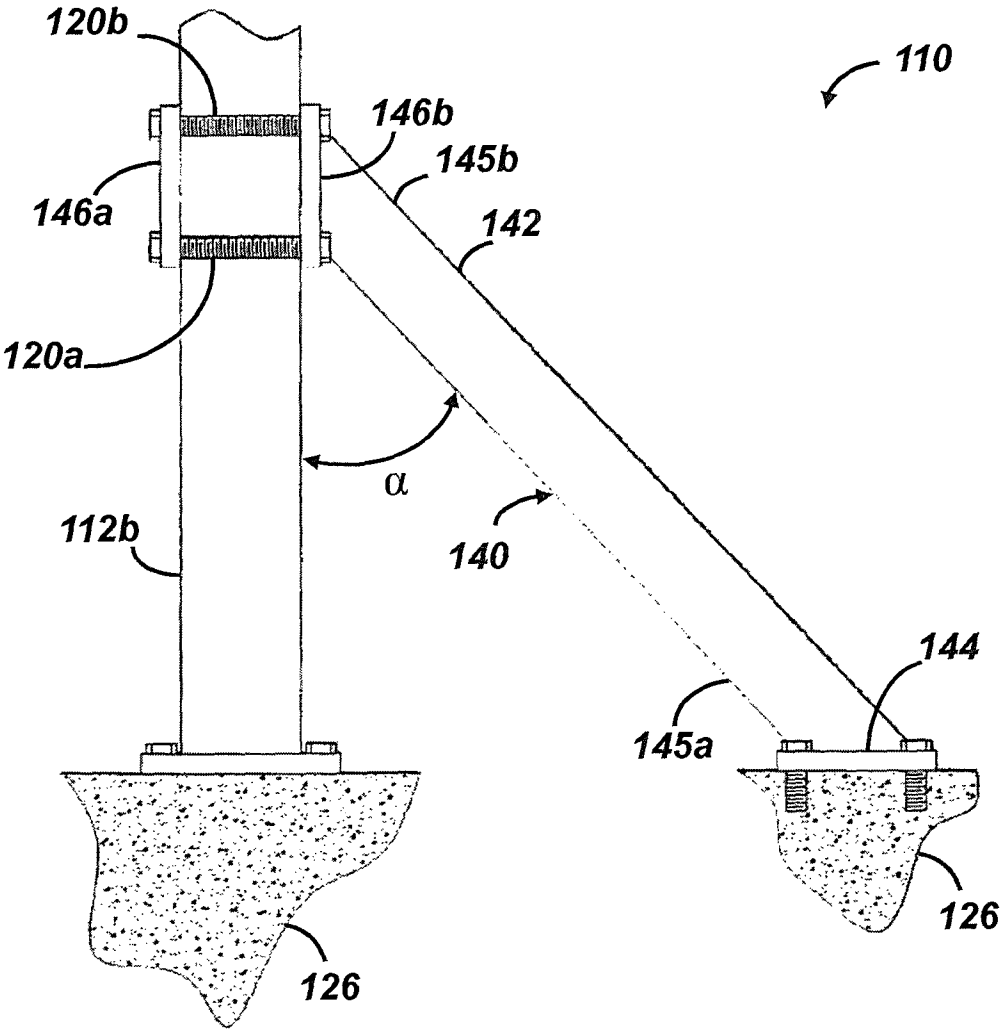
FIG. 4 is a left side view, in elevation, of a second embodiment of a punching bag gantry assembly.

Referring now to FIG. 4, another embodiment of a gantry assembly is shown generally at 110. Generally, the gantry assembly 110 differs from the gantry assembly 10 as shown in FIGS. 1 and 2, in that the gantry assembly 110 includes a stiffening assembly 140 attached to each of the support members (for purposes of clarity, only a single stiffening assembly 140 attached to a single support member is illustrated). The stiffening assemblies 140 are configured to structurally brace the gantry assembly 110, thereby providing additional resistance to the forces created during use of the suspended punching bags (not shown).

Referring again to FIG. 4, each of the stiffening assemblies 140 includes a bracing beam 142, a base plate 144, a first connector plate 146*a* and a second connector plate 146*b*.

The bracing beam 142 is configured to add structural support to the gantry assembly 110. In the illustrated embodiment, the bracing beam 142 is a tubular member having a square cross-sectional shape. In other embodiments, the bracing beam 142 can be other structural members or other cross-sectional shapes sufficient to add structural support to the gantry 110. In the illustrated embodiment, each side of the bracing beam 142 has a dimension of about 8.0 inches and the bracing beam 142 has a sectional area of 13.5 inches. However, the sides of the bracing beam 142 can be other desired sizes and have other desired sectional areas.

A first end 145*a* of the bracing beam 142 is attached to the base plate 144. In the illustrated embodiment, the first end 145*a* of the bracing beam 142 is welded to the base plates 144. However, in other embodiments the first end 145*a* of the bracing beam 142 can be attached to the base plate 144 with other desired methods, including the non-limiting example of mechanical clips.

Referring again to FIG. 4, the base plate 144 is attached to a floor 126 by fasteners 128. In the illustrated embodiment, the fasteners 128 are the same as, or similar to, the fasteners 28 described above and illustrated in FIG. 1. Alternatively, the fasteners 128 can be different from the fasteners 28. In still other embodiment, the base plate 144 can be attached to the floor 126 by other desired mechanisms, structures or devices.

A second end 145*b* of the bracing beam 142 is attached to the second connector plate 146*b*. In the illustrated embodiment, the bracing beam 142 is welded to the second connector plate 146*b*. In other embodiments, the bracing beam 142 can be attached to the second connector plate 146*b* with other desired methods.

Referring again to FIG. 4, the stiffening assembly 140 is installed with the following process. In a first step, the bracing beam 142 is positioned adjacent a support member 112*b* such that the attached second connector plate 146*b* is seated against the support member 112*b*. Next, the base plate 144 is attached to the floor 126. In a next step, the first connector plate 146*a* is positioned on a side of the support member 112*b* opposing the second connector plate 146*b* such that apertures in the first and second connector plates 146*a*, 146*b* align. Next, connectors 120*a*, 120*b* are positioned in the aligned apertures. In the illustrated embodiment, the connectors 120*a*, 120*b* are the same as the connectors 20*a*-20*h* described above and shown in FIGS. 1 and 2. However, in other embodiments the connectors 120*a*, 120*b* can be different from the connectors 20*a*-20*h*. The connectors 120*a*, 120*b* are tightened such that the bracing beam 142 is securely fastened to the support member 112*a*.

Referring again to FIG. 4, the bracing beam 142 forms an angle $\alpha$ with the support member 112*b*. The angle $\alpha$ is configured such that the bracing beam provides optimal resistance to the forces created during use of the suspended punching bags (not shown). In the illustrated embodiment, the angle $\alpha$ is in a range of from about 40° to about 60°. In other embodiments, the angle $\alpha$ can be more than 60° or less than about 40°.

While the embodiments of the punching bag gantry illustrated in FIGS. 1-4 and discussed above concern a lone structure for use with multiple suspended punching bags, it is within the contemplation of this invention that multiple gantries can be combined into a supporting structure. The combined structure can be configured to support any desired types of exercise equipment. Any desired quantity of gantries can be combined.

The principle and mode of operation of the punching bag gantry assembly has been described in certain embodiments. However, it should be noted that the punching bag gantry assembly may be practiced otherwise than as specifically illustrated and described without departing from its scope.

What is claimed is:

1. A gantry assembly for use with one or more suspended exercise objects, the gantry assembly comprising:

a plurality of opposing support members; and a main beam assembly supported by the plurality of support members, the main beam assembly having a first beam opposed by a second beam, the first beam having the cross-sectional shape of a channel with a flat major side opposed by an open side, the second beam having the cross-sectional shape of a channel with a flat major side opposed by an open side, wherein the open sides of the first and second beams are facing away from each other, the main beam further having spaced apart spacing members rigidly connected to the first and second beams and positioned between the first and second beams, the spacing members having the cross-sectional shape of a square tube and the spacing members having open top and bottom ends, wherein a longitudinal axis extending from the open top end to the open bottom end of the spacing members is perpendicular to a longitudinal axis extending along the length of the first and second beams;

wherein the one or more suspended exercise objects is connected to the spaced apart spacing members of the main beam assembly such as to prevent movement of the one or more suspended exercise objects along the length of the first and second beams; and wherein the gantry assembly is configured to support the weight of the one or more suspended exercise objects and further configured to support the impact and rotational forces created during use of the suspended exercise objects.

2. The gantry assembly of claim 1, wherein the suspended exercise objects are punching bags.

3. The gantry assembly of claim 1, wherein each of the support members has a square tubular cross-sectional shape.

4. The gantry assembly of claim 3, wherein each side of each support member has a dimension of 8.0 inches.

5. The gantry assembly of claim 1, wherein a base plate is attached to a first end of each support member.

6. The gantry assembly of claim 1, wherein a support plate is attached atop a second end of each support member.

7. The gantry assembly of claim 6, wherein the support plates are configured as a supporting surface for the main beam assembly.

8. The gantry assembly of claim 1, wherein each of the beams has a height of 8.0 inches and a sectional area of 5.51 square inches.

9. The gantry assembly of claim 1, wherein each side of each spacing member has a dimension of 4.0 inches and each of the spacing members has a sectional area of 6.02 inches.

10. The gantry assembly of claim 6, wherein each end of the main beam assembly is positioned between the support plate and a top plate.

11. The gantry assembly of claim 10, wherein connectors are configured to secure the main beam assembly between the support plates and the top plates.

12. The gantry assembly of claim 1, wherein a stiffening assembly is attached to the gantry assembly, and wherein the stiffening assembly is configured to structurally brace the gantry assembly.

13. The gantry assembly of claim 12, wherein the stiffening assembly comprises a bracing beam.

14. The gantry assembly of claim 13, wherein one end of the bracing beam is attached to the gantry assembly and the other end is attached to a floor.

15. The gantry assembly of claim 13, wherein the bracing beam has the cross-sectional area of a square tube, wherein each side of the bracing beam has a dimension of 8.0 inches and wherein the bracing beam has a sectional area of 13.5 inches.

16. The gantry assembly of claim 1, wherein the suspended exercise objects are positioned between the opposing support members.

* * * * *